United States Patent [19]

Lin

[11] Patent Number: 4,508,015

[45] Date of Patent: Apr. 2, 1985

[54] HYDRAULIC CYLINDER

[76] Inventor: Weihwang Lin, No. 33, Lane 199, Kung Yuan 2 Rd., Kaohsiung, Taiwan

[21] Appl. No.: 518,460

[22] Filed: Jul. 29, 1983

[51] Int. Cl.[3] ..... F01B 21/04; F01C 9/00

[52] U.S. Cl. ..... 92/2; 92/122; 92/165 PR

[58] Field of Search ..... 92/2, 165 PR, 122; 91/61; 173/108

[56] References Cited

U.S. PATENT DOCUMENTS 2,890,889 6/1959 Work ..... 92/2
3,766,831 10/1973 Yeakley ..... 92/2

FOREIGN PATENT DOCUMENTS 1153254 8/1963 Fed. Rep. of Germany ..... 92/2
12104 1/1982 Japan ..... 92/2

*Primary Examiner*—Paul E. Maslousky
*Attorney, Agent, or Firm*—Birch, Stewart, Kolasch & Birch

[57] ABSTRACT

A hydraulic cylinder including a closed cylinder in which are mounted a rotor for rotation about the axis thereof and two pistons for linear movement, the pistons being respectively sleeved onto two ends of the rotor and bounding a first arcuate fluid tight chamber with the inner surface of the cylinder and the peripheral surface of the rotor. At least one vane member is provided on the rotor for operating with the fluid to produce a rotational output. At least one piston rod is connected to one end of the rotor and mounted to the closed end of the cylinder in fluid tight relationship. On both sides of the first fluid tight chamber are two second fluid tight chambers bounded respectively by two pistons associated with the inner surfaces of the cylinder and the closed ends.

5 Claims, 8 Drawing Figures

HYDRAULIC CYLINDER

BACKGROUND OF THE INVENTION

This invention relates to a hydraulic cylinder, particularly to one that can produce more than one form of mechanical motion.

It is known that hydraulic actuators can produce mechanical works of linear output motion, rotary output motion and swinging motion according to their types. However, none of the type proposed heretofore can make two or more forms of output motion, and therefore, in the case of an apparatus in which more than one form of mechanical motion is desired, the applications of such actuators are found insufficient. For example, in testing mechanical properties of a material, a different apparatus is required which is capable of making linear, rotary, spiral movements, etc., for respectively tensioning, compression, bending, and twisting a test specimen so as to determine points of failure of the material, as the hydraulic actuator associated with an apparatus can only produce one form of output motion. A mechanical arm of a hydraulically operated apparatus for carrying or conveying a load sometimes needs linear movement, sometimes rotary movement, are sometimes even spiral movement. In such apparatus, two or more types of hydraulic actuators are required for operation, and this has increased the construction cost and volume requirement. Consequently, it is desirable to make improvements on these conventional hydraulic actuators.

SUMMARY OF THE INVENTION

According to the invention, a hydraulic actuator includes a closed cylinder in which a rotor for rotation about the axis thereof, and two circular piston members respectively connected to two ends of the rotor in a coaxial relationship are mounted. The peripheries of the piston members are sealingly engaged with the inner surface of the cylinder, and form a first fluid tight arcuate chamber with the peripheral surface of the rotor and the inner surface of the cylinder. Each of the piston members forms a second fluid tight chamber on either side of the first chamber, with the inner surface of the cylinder and closed ends of the cylinder. Between the peripheral surface of the rotor and the inner surface of the cylinder are provided barrier means and vane means, thereby dividing the first arcuate chamber into at least two variable volume regions. Two piston rods are respectively connected to two ends of the rotor and journalled in the closed ends of the cylinder. First port means for admitting and returning the hydraulic fluid are respectively communicated with the second chambers so as to make the fluid work on the two piston members to produce a linear motion. Second port means for admitting and returning the hydraulic fluid are respectively communicated with two variable volume regions so as to make the fluid work on the vane member to produce a rotary motion.

Advantageously, the barrier means is passed through the piston members and extended to the closed ends of the cylinder, so that the piston member will not make a rotary motion accompanying the motion of the rotor.

In one aspect of the invention, the vane means may include two vane members and barrier means may include two barrier members, thereby dividing the first arcuate chamber into four variable volume regions. The second port means may include four second ports, each two second ports being provided in one of the barrier members and communicated with two of variable volume regions on both sides of the barrier member.

An object of the invention is to provide a hydraulic cylinder that can produce a mechanical output of linear motion, rotary motion or a combined linear and rotary motion.

The manner in which the above and related objects are accomplished together with the attending advantages and features of the invention appear more fully from the following detailed description and drawings.

DETAILED DESCRIPTION OF THE PREFERRED EMBODIMENT

Figure 1:
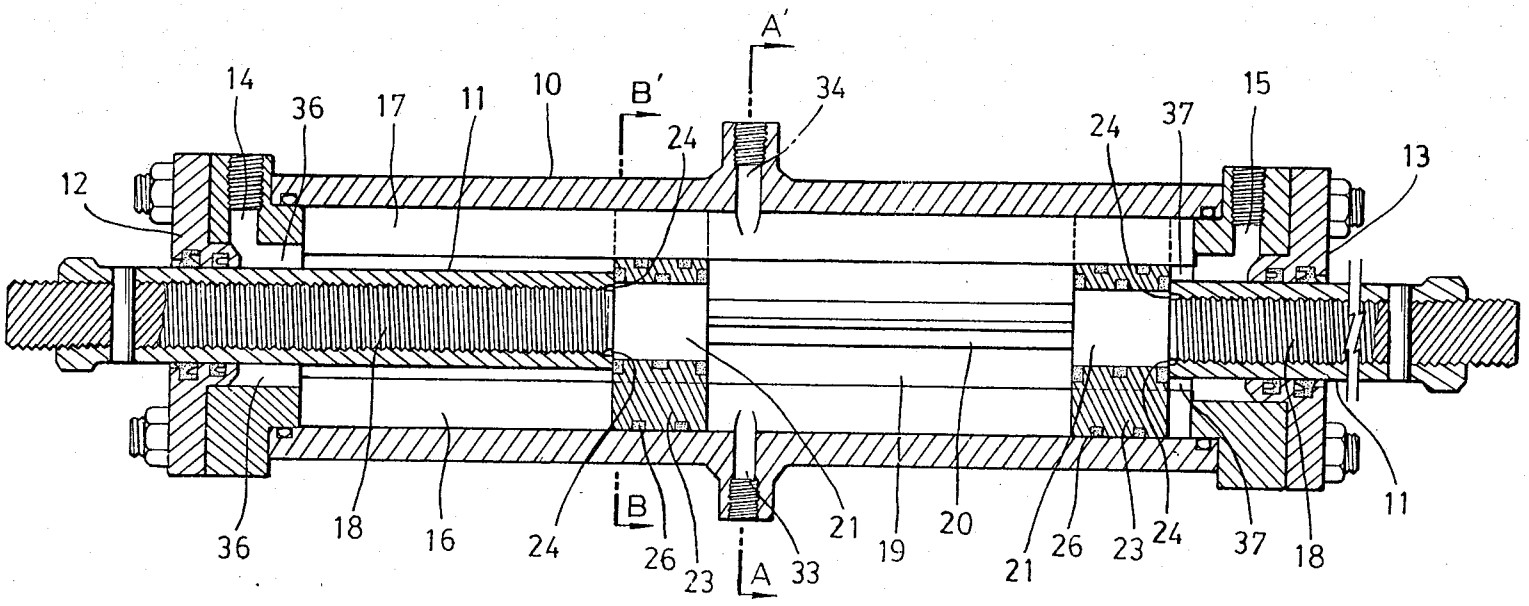
FIG. 1 is a sectional view of a hydraulic cylinder constructed according to the present invention.
Figure 2:
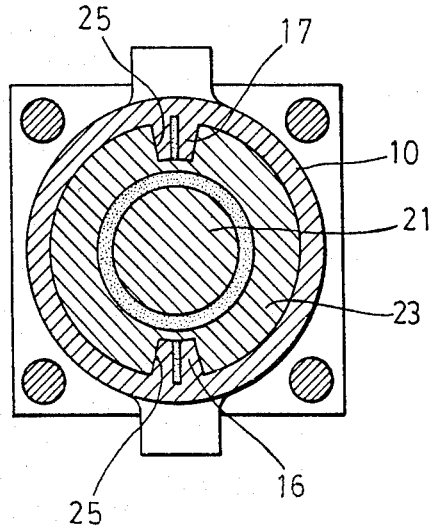
FIG. 2 is a sectional view taken from the line B—B' of FIG. 1.
Figure 3:
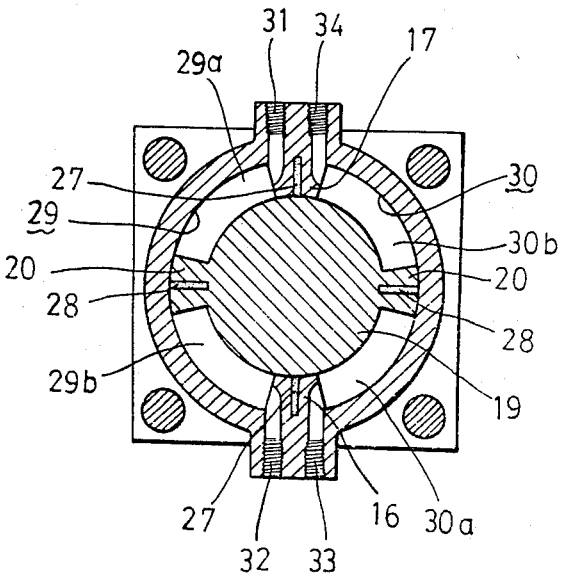
FIG. 3 is a sectional view taken from the line A—A' of FIG. 1.

Referring to FIGS. 1, 2 and 3 there is shown a cylinder 10 which is closed at two ends thereof and in which are mounted linearly movable piston rods 11 in fluid tight relationship with the closed ends 12 and 13 respectively. At the closed ends 12 and 13 are respectively provided two ports 14 and 15. As the construction of the cylinder 10 and the mounting of the piston rods 11 are known in the art, the detail thereof is not described hereinunder. Two barrier members 16 and 17 are integrally formed at the inner surface of the cylinder in diametrically opposed positions and extending from one end 12 to another end 13.

There is further provided a rotor 19 which has two diametrically opposite vanes 20 and two cylindrical ends 21. Two piston members 23 are respectively sleeved, in fluid tight relationship by means of sealing means, onto the ends 21 which are respectively connected to two piston rods 11 mounted in the closed ends 12 and 13. Two screw rods 18 are respectively screwed in the piston rods 11 and the ends 21 so that the end faces 24 of the piston rods 11 are respectively abutted against the piston members 23. However, the rotor 19 can be connected to one piston rod 11 with one end thereof, wherein only one power take-off means will exist.

Each of the piston members 23 has a cross-section of circular shape with two diametrically opposite notches 25 for sealing engagement with barriers 16 and 17 respectively. The peripheries of the pistons 23 are sealingly engaged with the inner surface of the cylinder 10 by providing sealing means 26 in a known manner. As the pistons 23 are engaged with the barriers, they can not make rotary motion during the rotation of the rotor 19. The periphery of the rotor 19 and the extremities of the vanes 20 are sealingly engaged with the barriers 16, 17 and the inner surface of the cylinder respectively. The sealing engagement can be accomplished in a known manner by using sealing means 27, 28. The pistons 23, the peripheral surface of the rotor 19, barriers 16 and 17, and the inner surface of the cylinder mutually bound two fluid tight chambers 29 and 30, and the vanes 20 divide the chambers 29 and 30 into four variable volume regions 29*a*, 29*b*, 30*a* and 30*b* respectively. The volumes of the regions 29*a*, 29 *b*, 30*a* and 30*b* are variable during rotation of the vanes 20. In the barriers 16 and 17 are respectively provided four ports 31, 32, 33, and 34 which are respectively communicated with the regions 29*a*, 29*b*, 30*a* and 30*b*. These ports 31, 32, 33 and 34 will be communicated with the hydraulic power supply (not shown) through directional control valves (not shown) for admitting and returning the hydraulic fluid depending on the desired angular direction of the motion of the rotor 19.

Referring again to FIG. 1, the pistons 23 respectively bound two chambers 36 and 37 with the inner surface of the cylinder 10 and the respective closed ends 12 and 13. These chambers 36 and 37 are respectively communicated with the ports 14 and 15 which will be connected to the hydraulic power supply (not shown) through a directional control valve (not shown).

Figure 5:
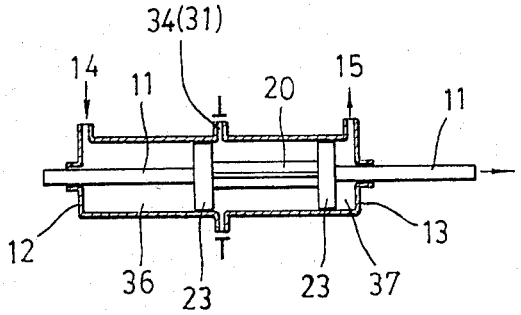
FIGS. 4, 5, 6 and 7 illustrate different operation conditions of the hydraulic cylinder.
Figure 4:
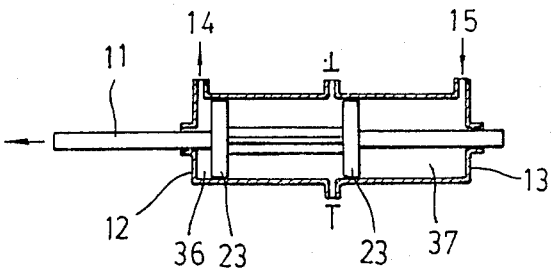

In operation, the hydraulic fluid is admitted into the cylinder 10 and returned to the hydraulic supply through chosen ports, depending on the desired mechanical output motion. Referring to FIG. 4, the fluid is admitted into the chamber 37 through the port 15 and the fluid in the chamber 36 is returned through the port 14. Due to the entering fluid in the chamber 37, the piston 23 is moved towards the end 12. If it is desired to move the piston 23 towards the end 13, the fluid must be admitted into the chamber 36 through the port 14 and returned through the port 15 is as shown in FIG. 5. The movement of the pistons 23 in an axial direction as shown in FIGS. 4 and 5 will produce a mechanical output of linear motion. During this operation, the ports 31, 32, 33 and 34 are preferably kept in their closed positions so that the vanes 20 will not be moved in the angular direction.

Figure 6:
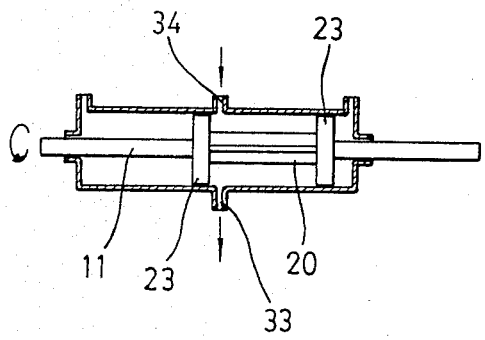

The rotating operation of the actuator 1 is illustrated in FIG. 6. The fluid is admitted through the ports 32 and 34 and returned through the ports 31 and 33. The action of the fluid on the vanes 20 will produce an output rotation of nearly 120°. During rotation, it is preferable to make the ports 14 and 15 closed.

Figure 7:
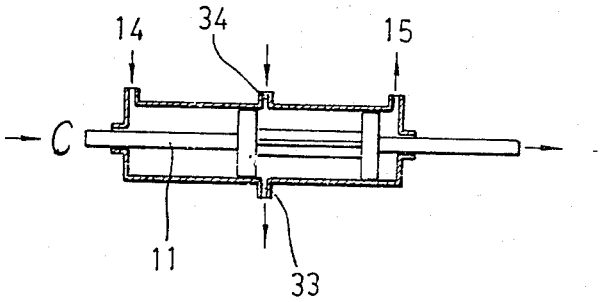

If a combined linear and rotation output is required, the fluid must be admitted and returned through the ports 14 and 15 for linear motion and through the ports 31, 32, 33 and 34 for rotary motion as shown in FIG. 7. In this case the fluid will work on both vanes 20 and pistons 23 to actuate a power takeoff means, herein referred as, the piston rod 11 to make both linear and rotational motions.

Figure 8:
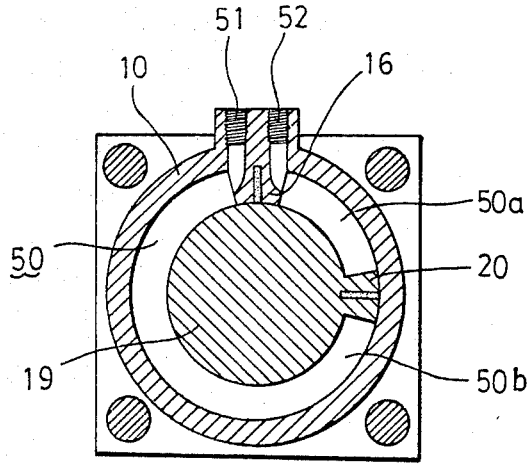
FIG. 8 is a sectional view illustrating an alternative form of the hydraulic cylinder constructed according to the present invention.

Alternatively, the hydraulic cylinder may include only one barrier 16 and the rotor 19 may be only provided with one vane member 20 as shown in FIG. 8. In this case, the barrier 16, the inner surface of the cylinder, and the peripheral surface of the rotor bound a segmented arcuate chamber 50 which will be, divided by the vane member 20 into two variable volume regions 50*a* and 50*b*. Two ports 51 and 52 are provided in the barrier 16 for admitting and returning the hydraulic fluid in the chamber and communicated with the two regions 50*a* and 50*b* respectively. The action of the fluid on the vane member 20 will produce a rotation output of a greater angle than that of the case in which two vanes are provided.

As the hydraulic actuator constructed according to the invention can produce mechanical works of linear motion, rotary motion and a combined linear and rotary motion, it can improve the performance of a hydraulically operated machine with which it is incorporated as well as reduce the cost thereof.

With the invention thus explained, it is apparent that obvious modifications and variations can be made without departing from the scope of the invention. It is therefore intended that the invention be limited only as indicated in the appended claims.

I claim:

1. A hydraulic cylinder comprising:

a cylinder having two closed ends for receiving a hydraulic fluid;

a rotor mounted for rotation about the axis of said cylinder;

two circular piston members respectively sleeved onto two ends of said rotor and having their peripheries sealingly engaged with an inner surface of said cylinder, said piston members bounding a first fluid tight arcuate chamber with the peripheral surface of said rotor and the inner surface of said cylinder, each of said piston members bounding, a second fluid tight chamber at one side of said first chamber, with the inner surface of said cylinder and one of said closed ends;

vane means provided on said rotor and sealingly engaged with the inner surface of said cylinder;

barrier means provided in said first arcuate chamber, whereby said first arcuate chamber is divided by said barrier means and vane means into at least two variable volume regions of segmented arcuate shapes;

at least one piston rod attached to one end of said rotor in a coaxial relationship and slidably mounted through one of said closed ends in fluid tight relationship;

first port means for admitting and returning the hydraulic fluid respectively communicated with said second chambers; and second port means for admitting and returning the hydraulic fluid respectively communicated with said two regions of said first arcuate chamber;

said vane means includes one vane member, and said barrier means includes one barrier member, said vane member and said barrier member dividing said first arcuate chamber into two regions of variable volume, said barrier member extending through said piston members and up to said closed ends of said cylinder, and in which each of said piston members includes a lateral notch for receiving said barrier member.

2. A hydraulic cylinder as claimed in claim 1, wherein said second port means includes two second ports provided in said barrier member and communicated with said two variable volume regions on both sides of said barrier member.

3. A hydraulic cylinder as claimed in claim 1, wherein said vane means includes two vane members provided on said rotor in diametrically opposed postions, and in which said barrier means includes two barrier members provided in said first arcuate chamber in diametrically opposed positions relative to said rotor, said vane members and barrier members dividing said first chamber into four variable volume regions.

4. A hydraulic cylinder as claimed in claim 3, wherein said second port means includes four second ports, a pair of said second ports being provided in each one of said barrier members and communicated with two of said variable volume regions respectively on both sides of said one barrier member.

5. A hydraulic cylinder as claimed in claim 4, wherein each of said barrier members extending through said piston members and up to said closed ends of said cylinder, and in which each of said piston members includes two diametrically opposite notches for receiving said barrier members.

* * * * *